US007848923B2

(12) United States Patent
Byun et al.

(10) Patent No.: US 7,848,923 B2
(45) Date of Patent: Dec. 7, 2010

(54) METHOD FOR REDUCING DECODER COMPLEXITY IN WAVEFORM INTERPOLATION SPEECH DECODING BY CONVERTING DIMENSION OF VECTOR

(75) Inventors: Kyung Jin Byun, Daejeon (KR); Ik Soo Eo, Daejeon (KR); Hee Bum Jung, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 860 days.

(21) Appl. No.: 11/409,583

(22) Filed: Apr. 24, 2006

(65) Prior Publication Data

US 2007/0027684 A1 Feb. 1, 2007

(30) Foreign Application Priority Data

Jul. 28, 2005 (KR) ..... 10-2005-0069015

(51) Int. Cl.
*G10L 19/12* (2006.01)

(52) U.S. Cl. ..... 704/222; 704/E19.029; 704/219

(58) Field of Classification Search ..... 704/222
See application file for complete search history.

(56) References Cited

U.S. PATENT DOCUMENTS 5,890,110 A * 3/1999 Gersho et al. ..... 704/222
6,018,707 A * 1/2000 Nishiguchi et al. ..... 704/222
6,377,914 B1 4/2002 Yeldener
6,493,664 B1 12/2002 Udaya Bhaskar et al.
2004/0002856 A1* 1/2004 Bhaskar et al. ..... 704/219
2006/0069554 A1* 3/2006 Gottesman et al. ..... 704/222

OTHER PUBLICATIONS

Jing Li, Changchun Bao, "Quantization of SEW and REW magnitude for 2 kb/s waveform interpolation speech coding" Publication Date: Dec. 15-18, 2004, pp. 141-144.*
A. Das, A. Rao, and A. Gersho, "Variable-dimension vector quantization of speech spectra for low-rate vocoders," in Proceedings of the Data Compression Conference, pp. 421-429, 1994.*
A. Das, A. Gersho, A variable-rate natural quality parametric speech coder, IEEE Int. Conf on Communication.s, vol. 1, pp. 216-220, May 1994.*
Lupini, P. and V. Cuperman (Nov. 1994). Vector quantization of harmonic magnitudes for lowrate speech coders. In GLOBECOM, pp. 858-862.*

(Continued)

*Primary Examiner*—Talivaldis Ivars Smits
*Assistant Examiner*—Greg A Borsetti
(74) *Attorney, Agent, or Firm*—Ladas & Parry LLP

(57) ABSTRACT

Provided is a method for converting a dimension of a vector. The vector dimension conversion method for vector quantization includes the steps of: extracting a specific parameter having a pitch period from an input speech signal and then generating a vector of a dimension that varies according to the pitch period; dividing an entire frequency domain of the generated vector of the variable dimension into at least two frequency domains; and converting the vector of the variable dimension into vectors of mutually different fixed dimensions according to the divided frequency domains. Thereby, not only an error due to the vector dimension conversion is suppressed but codebook memory required for the vector quantization is effectively reduced.

8 Claims, 3 Drawing Sheets

OTHER PUBLICATIONS

C. Li, E. Shlomot, and V. Cuperman, "Quantization of variable dimension spectral vectors," in Proc. 32nd Asilomar Conf. Signals, Systems, and Computers, 1998, pp. 352-356.*
Hongtao Hu, Limin Du, "A New Low Bit Rate Speech Coder Based On Intraframe Waveform Interpolation", ICSLP 2000, Oct. 16-20, 2000.*
C. H. Ritz, I. S. Burnett, J. Lukasiak, "Low bit rate wideband WI speech coding," Proc. IEEE International Conference on Acoustics, Speech, and Signal Processing, pp. 804-807, 2003.*
J. Nurminen, A. Heikkinen, J. Saarinen, "Objective Evaluation of Methods for Quantization of Variable- Dimension Spectral Vectors in WI Speech Coding" in Proc. Eurospeech 2001, Sep. 2001, pp. 1969-1972.*
Nurminen, Jani; Ari Heikkinen; Jukka Saarinen, "Quantization of magnitude spectra in waveform interpolation speech coding", NORSIG-2001, Norsk symposium i signalbehandling, Oct. 18-20, 2001, Trondheim, Norge 2001.*
Ritz. C.H., Bumetl, I.S. and Lukasiak, I., "Extending Waveform Interpolation to Wideband Speech Coding", Proc. 2002 IEEE Workshop on Speech Coding, Japan, Oct. 2002.*
M. Nishiguchi and J. Matsumoto, "Harmonic and noise coding of LPC residuals with classified vector quantization," Proc. IEEE Int. Conf. Acoustics, Speech, Signal Processing Detroit, pp. 484-487, 1995.*
E. Shlomot, V. Cuperman, and A. Gersho, "Hybrid coding: Combined harmonic and waveform coding of speech at 4 kb/s," IEEE Trans. Speech Audio Process., vol. 9, No. 6, pp. 632-646, Sep. 2001.*
A. Das, A. V. Rao, and A. Gersho, "Variable dimension vector quantization," IEEE Signal Processing Lett., vol. 3, pp. 200-202, Jul. 1996.*
"A 2400 bps Multi-Band Excitation Vocoder" 1990. Meuse, Voice Communications Group, Sanders Associates, Inc., Nashua, NH, pp. 9-12.*
J. Thyssen, W. B. Kleijn, and R. Hagen, "Using a perception-based frequency scale in waveform interpolation," in Proc. IEEE ICASSP'97, pp. 1595-1598.*
W. Bastiaan Kleijn, "A frame interpretation of sinusoidal coding and waveform interpolation," in Proc. IEEE Int. Conf. Acoust., Speech, Signal Processing, Istanbul, 2000, vol. 3, pp. 1475-1478.*
O.Gottesman, A.Gersho, "Enhanced Waveform Interpolative Coding at Low Bit-rate", IEEE Trans.Speech Audio Processing, vol. 9, No. 8, pp. 242-250, 2001.*
E. Choy, Waveform Interpolation Speech Coder ai 4 kb/s, Master of Engineering Thesis, Department of Electrical Engineering, McGill University, Montreal, Canada, Aug. 1998.*
'Parametric Speech Coding-HVXC At 2.0-4.0 KBPS' Nishiguchi et al., Media Processing Laboratories, Sony Corporation, Japan, 1999 IEEE, pp. 84-86.

* cited by examiner

METHOD FOR REDUCING DECODER COMPLEXITY IN WAVEFORM INTERPOLATION SPEECH DECODING BY CONVERTING DIMENSION OF VECTOR

CROSS-REFERENCE TO RELATED APPLICATION

This application claims priority to and the benefit of Korean Patent Application No. 2005-69015, filed Jul. 28, 2005, the disclosure of which is incorporated herein by reference in its entirety.

BACKGROUND

1. Field of the Invention

The present invention relates to a method for converting a dimension of a vector, and more particularly, to a method for converting a dimension of a vector in waveform interpolation (WI) speech coding for converting elements of low and high frequency domains of a spectrum vector having a variable dimension into vectors having fixed dimensions, using only one codebook memory for slowly evolving waveform (SEW) spectrum vector quantization, such that each of the elements has different resolution from each other, thereby not only suppressing errors due to the vector dimension conversion but also effectively reducing codebook memory required for vector quantization.

2. Discussion of Related Art

In recent mobile communication systems, digital multimedia storage devices, and so forth, various kinds of speech coding algorithms have been frequently used in order to maintain the original sound quality of a speech signal with relatively few bits.

In general, a code excited linear prediction (CELP) algorithm is an effective coding method that maintains high sound quality even at a low bit rate of between 8 and 16 kbps.

An algebraic CELP coding method, which is one type of CELP coding method, is so successful that it has been adopted in many recent worldwide standards such as G.729, enhanced variable rate codec (EVRC), and adaptive multirate (AMR) vocoders.

However, according to the CELP algorithm, sound quality seriously deteriorates at a bit rate of under 4 kbps. Therefore, the CELP algorithm is known not to be appropriate in fields applying a low bit rate.

Meanwhile, WI speech coding is a speech coding method that guarantees good sound quality even at a low bit rate of below 4 kbps. According to the WI speech coding method, four parameters are extracted from an input speech signal, the four parameters being a linear prediction (LP) parameter, a pitch value, a power, and a characteristic waveform (CW).

Here, the CW parameter is divided again into two parameters of a slowly evolving waveform (SEW) and a rapidly evolving waveform (REW). Since the SEW parameter and the REW parameter have very different characteristics from each other, the two parameters are separately quantized to improve coding efficiency.

The SEW parameter is known to affect sound quality the most among the five parameters of a WI vocoder. Furthermore, a dimension of a SEW spectrum vector depends on a pitch period, and thus a variable dimension quantization method is required for SEW spectrum vector quantization.

However, a vector of the SEW variable dimension is hard to quantize by directly applying a conventional general quantization method, and thus a dimension conversion method is generally used for the variable dimension vector quantization.

In other words, when the vector dimension conversion method is used, the SEW spectrum vector can be quantized by applying the conventional general quantization method.

Meanwhile, the SEW parameter can be considered as the same kind of parameter as a harmonic magnitude vector in harmonic vocoders excluding WI vocoders.

Therefore, harmonic magnitude vector quantization in a WI vocoder and a harmonic vocoder requires harmonic vector dimension conversion in order to apply the conventional general quantization method in the same manner as the SEW parameter quantization mentioned above.

SUMMARY OF THE INVENTION

The present invention is directed to a method for converting a dimension of a vector for SEW spectrum vector quantization in WI speech coding. According to the method, an entire frequency domain of a variable dimension vector is divided into a plurality of frequency domains, and then the variable dimension vector is converted into vectors of different fixed dimensions according to the divided frequency domains. Thereby, errors due to the vector dimension conversion can be suppressed and codebook memory required for the vector quantization can be effectively reduced.

One aspect of the present invention is to provide a method for converting a dimension of a vector for vector quantization, the method comprising the steps of: extracting a specific parameter having a pitch period from an input speech signal and then generating a vector of a dimension that varies according to the pitch period; dividing an entire frequency domain of the generated vector of the variable dimension into at least two frequency domains; and converting the vector of the variable dimension into vectors of mutually different fixed dimensions according to the divided frequency domains.

Here, the variable dimension vector is preferably a SEW spectrum vector or a harmonic vector.

Preferably, when the entire frequency domain of the variable dimension vector is divided into a low frequency domain and a high frequency domain, variable dimension vectors corresponding to the low frequency domain are converted into vectors of a maximum fixed dimension, and variable dimension vectors corresponding to the high frequency domain are converted into vectors of a lower fixed dimension than the maximum fixed dimension.

BRIEF DESCRIPTION OF THE DRAWINGS

The above and other features and advantages of the present invention will become more apparent to those of ordinary skill in the art by describing in detail exemplary embodiments thereof with reference to the attached drawings in which.

DETAILED DESCRIPTION OF EXEMPLARY EMBODIMENTS

Hereinafter, an exemplary embodiment of the present invention will be described in detail. However, the present invention is not limited to the exemplary embodiments disclosed below, but can be implemented in various types. Therefore, the present exemplary embodiment is provided for complete disclosure of the present invention and to fully inform the scope of the present invention to those of ordinary skill in the art.

Figure 1:
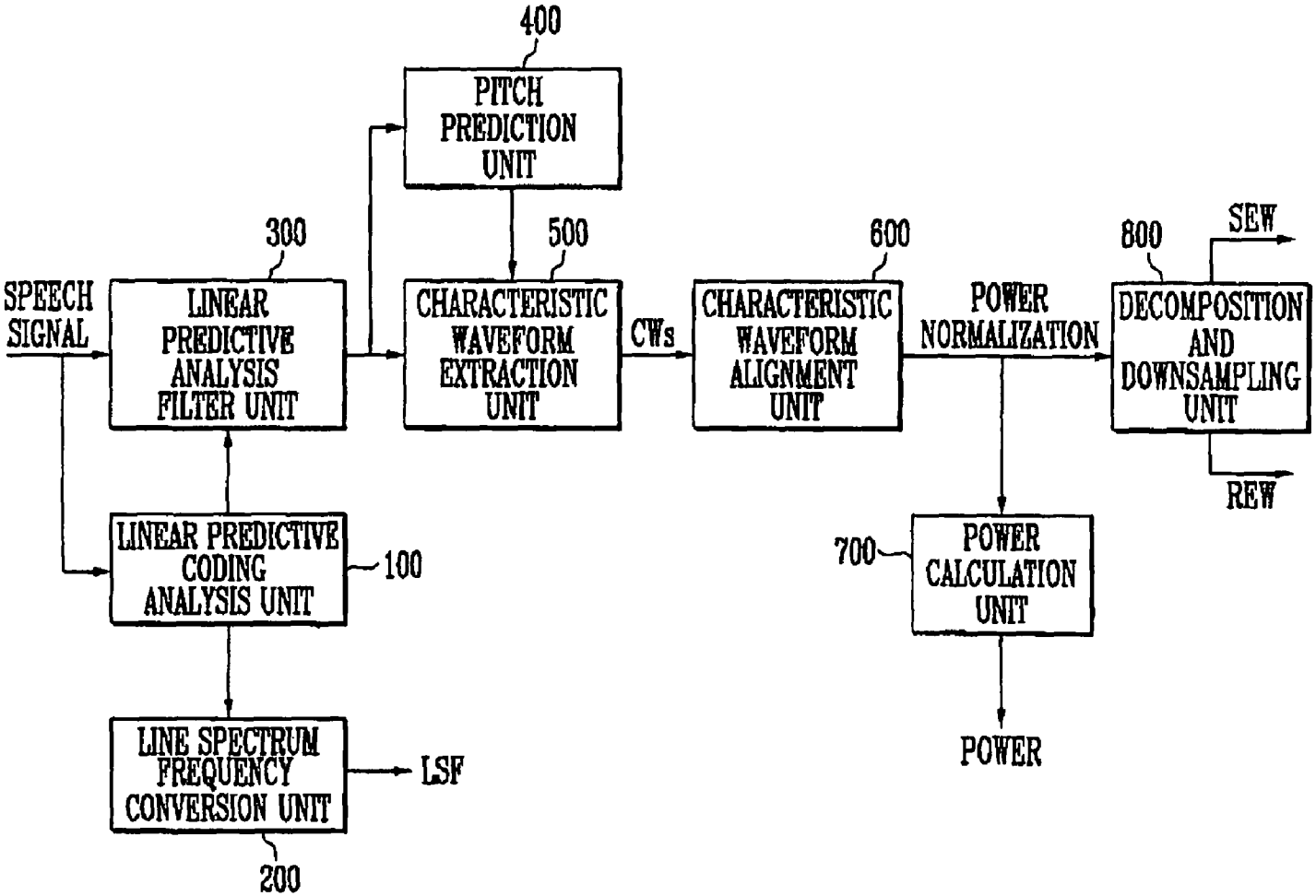
FIG. 1 is a block diagram showing an encoding process of a waveform interpolation (WI) vocoder employing a vector dimension conversion method according to an exemplary embodiment of the present invention.

FIG. 1 is a block diagram showing an encoding process of a WI vocoder employing a vector dimension conversion method according to an exemplary embodiment of the present invention.

Referring to FIG. 1, a device for handling the encoding process of the WI vocoder employing the vector dimension conversion method according to an exemplary embodiment of the present invention comprises a linear predictive coding analysis unit 100, a line spectrum frequency conversion unit 200, a linear predictive analysis filter unit 300, a pitch prediction unit 400, a characteristic waveform extraction unit 500, a characteristic waveform alignment unit 600, a power calculation unit 700, and a decomposition and downsampling unit 800.

Here, the linear predictive coding analysis unit 100 performs a LP analysis on a predetermined input speech signal once per frame and extracts linear predictive coding (LPC) coefficients.

The line spectrum frequency conversion unit 200 is provided with the extracted LPC coefficients from the linear predictive coding analysis unit 100 and converts the extracted LPC coefficients into line spectrum frequency (LSF) coefficients for efficient quantization.

The linear predictive analysis filter unit 300 is configured with the LPC coefficients extracted from the linear predictive coding analysis unit 100 and outputs a predetermined linear prediction residual signal from the input speech signal.

The pitch prediction unit 400 receives the linear prediction residual signal output from the linear predictive analysis filter unit 300 and outputs a predetermined pitch value using a common pitch prediction method.

The characteristic waveform extraction unit 500 receives the LP residual signal and pitch value respectively output from the linear predictive analysis filter unit 300 and the pitch prediction unit 400 and extracts pitch-cycle waveforms at a constant rate, which is known as (CWs).

The characteristic waveform alignment unit 600 is provided with the extracted CWs output from the characteristic waveform extraction unit 500 and aligns the CWs through a circular time shift process.

The power calculation unit 700 calculates power of a CW separated through power normalization of the CWs aligned by the characteristic waveform alignment unit 600 and outputs the power as a normalization factor.

The decomposition and downsampling unit 800 is provided with a shape of the CW separated through the power normalization of the aligned CWs from the characteristic waveform alignment unit 600, decomposes the shape into a SEW and a REW, and then downsamples the decomposed SEW and REW.

Hereinafter, the encoding process of the WI vocoder employing the vector dimension conversion method described above according to an exemplary embodiment of the present invention will be described in detail.

With one frame consisting of, e.g., 320 samples (20 msec) of a speech signal sampled at about 16 kHz, parameters, i.e., LP, a pitch value, power of a CW, a SEW and a REW, are extracted, respectively.

First, the linear predictive coding analysis unit 100 performs a LP analysis on an input speech signal once per frame, and extracts LPC coefficients.

Subsequently, the line spectrum frequency conversion unit 200 is provided with the extracted LPC coefficients from the linear predictive coding analysis unit 100, converts the extracted LPC coefficients into LSF coefficients for efficient quantization, and performs quantization using various vector quantization methods.

When the input speech signal passes through the linear predictive analysis filter unit 300 which is configured with the LPC coefficients extracted from the linear predictive coding analysis unit 100, a linear prediction residual signal is obtained.

Subsequently, the pitch prediction unit 400 receives the linear prediction residual signal output from the linear predictive analysis filter unit 300 and calculates a pitch value using a common pitch prediction method. Here, an autocorrelation method (ACM) is preferably used as the common pitch prediction method.

After the pitch value is calculated, the characteristic waveform extraction unit 500 extracts CWs having the pitch period at a constant rate from the linear prediction residual signal. The CWs are usually expressed with the discrete time Fourier series (DTFS) as shown in Formula 1:

$$u(n, \phi) = \sum_{k=1}^{[P(n)/2]} [A_k(n)\cos(k, \phi) + B_k(n)\sin(k, \phi)] \qquad \text{Formula 1}$$

$$0 \le \phi(\cdot) < 2\pi$$

Here, $\Phi=\Phi(m)=2\pi m/P(n)$, and $A_k$ and $B_k$ are DTFS coefficients. And, P(n) is a pitch value.

In result, the CW extracted from the linear prediction residual signal is the same as a waveform of a time domain transformed by the DTFS. Since the CWs are generally not in phase along the time axis, it is required to smooth down the CWs as flat as possible in the direction of the time axis.

Specifically, a currently extracted CW is processed by a circular time shift to be aligned to a previously extracted CW while the currently extracted CW passes through the characteristic waveform alignment unit 600, and thereby the CW is smoothed down.

The DTFS expression of a CW can be considered as a waveform extracted from a periodic signal, and thus in result the circular time shift can be considered as the same process as adding a linear phase to the DTFS coefficients.

Subsequently, the CWs are aligned by the characteristic waveform alignment unit 600 and then separated into a shape and power through power normalization.

The power separated from the CW is separately quantized by passing through the power calculation unit 700, and the shape separated from the CW is decomposed into a SEW and REW by passing through the decomposition and downsampling unit 800. Such a power normalization process is required for improving coding efficiency by separating the CW into the shape and power and separately quantizing them.

Specifically, when the extracted CWs are arranged on the time axis, a two-dimensional surface is formed. The two-dimensional CWs are decomposed into two separate components of the SEW and REW via low-pass filtering.

The SEW and REW each are processed by a downsampling scheme and then finally quantized. As a result, the SEW represents a periodic signal (voiced component) most, and the REW represents a noise signal (unvoiced component) most.

Since the components have very different characteristics from each other, the coding efficiency is improved by dividing and separately quantizing the SEW and REW.

Specifically, the SEW is quantized to have high accuracy and a low transmission rate, and the REW is quantized to have low accuracy and a high transmission rate. Thereby, final sound quality can be maintained.

In order to use such characteristics of a CW, a two-dimensional CW is processed via low-pass filtering on the time axis so that the SEW element is obtained, and the SEW signal is subtracted from the entire signal as shown in Formula 2 so that the REW element is easily obtained:

$$u_{REW}(n,\phi)=u_{CW}(n,\phi)-u_{SEW}(n,\phi) \quad \text{Formula 2}$$

Using the linear prediction, pitch value, power of a CW, and parameters of the SEW and REW extracted as described above, original speech is decoded by a decoder.

Specifically, the decoder interpolates successive SEW and REW parameters, and then synthesizes the two signals so that the successive original CW is restored. The power is added to the restored CW, and then the alignment process is performed.

A finally obtained two-dimensional CW signal is converted into a linear prediction residual signal of the one dimension. Here, phase estimation using a different pitch value for each sample is required. The residual signal of the one dimension passes through a LP synthesis filter, and thereby the original speech signal is finally restored.

Figure 2:
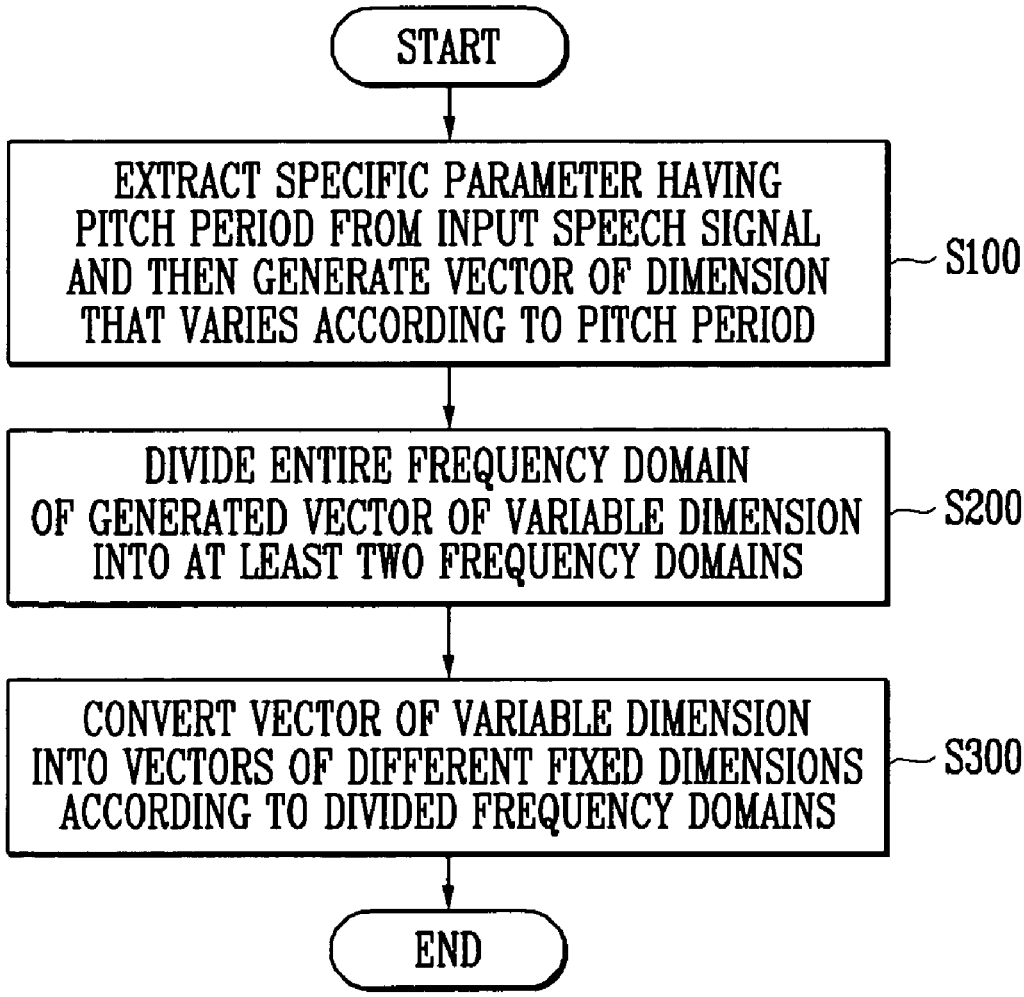
FIG. 2 is a flowchart showing the vector dimension conversion method according to an exemplary embodiment of the present invention.
Figure 3:
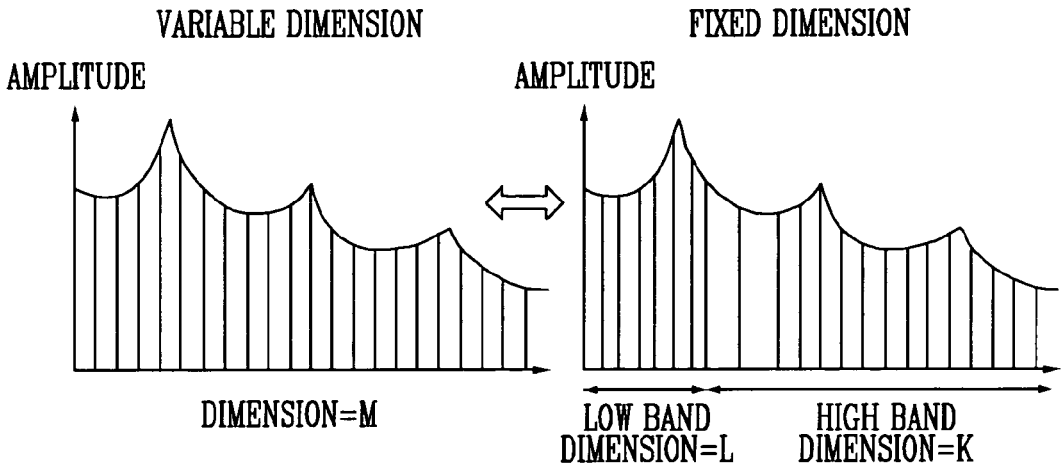
FIG. 3 is a pair of figures illustrating the vector dimension conversion method according to an exemplary embodiment of the present invention.

FIGS. 2 and 3 are a flowchart and a pair of figures showing the vector dimension conversion method according to an exemplary embodiment of the present invention, respectively.

Referring to FIGS. 2 and 3, first, a specific parameter having a pitch period is extracted from the input speech signal, and then a vector is generated having a dimension that varies according to the pitch period (S100).

Specifically, CWs are extracted from the linear prediction residual signal as described above, the length of each CW varies according to a pitch period P(t). When a waveform is converted in a frequency domain for effective quantization, the most compact representation contains frequency domain samples at multiples of the pitch frequency. Therefore, a vector of such a form has a variable dimension as shown in Formula 3:

$$M(t) = \left[\frac{P(t)}{2}\right]. \quad \text{Formula 3}$$

For example, with respect to a speech signal sampled at about 8 kHz, a pitch value P may vary between 20 (2.5 msec) and 148 (18.5 msec), and thereby M, the number of harmonics, has a value between 10 and 74.

In other words, a dimension of a harmonic vector becomes a variable dimension between 10 and 74. With respect to a broadband speech signal sampled at about 16 kHz, a pitch value P is between 40 and 296, and thus the dimension of the harmonic vector has a value between 20 and 148.

Therefore, a codebook for quantizing such a vector becomes two times larger than a narrowband speech. Thus, a codebook memory problem is more serious in the case of wideband speech than narrowband speech.

Subsequently, an entire frequency domain of the generated variable dimension vector is divided into at least two frequency domains (S200), and then the variable dimension vector is converted into vectors of different fixed dimensions according to the divided frequency domains (S300).

For example, according to an exemplary embodiment of the present invention, when the pitch period P(t) is restricted between 40 and 256, the variable dimension of the harmonic vector, M, is between 20 and 128.

When the entire frequency domain of the variable dimension vector is divided into a low frequency domain and a high frequency domain, variable dimension vectors corresponding to the low frequency domain are converted into vectors of a maximum fixed dimension, and variable dimension vectors corresponding to the high frequency domain are converted into vectors of a lower fixed dimension.

Specifically, when the entire frequency domain of the variable dimension vector is divided into a low frequency domain $f_{Low}$ and a high frequency domain $f_{High}$, each of the variable dimension vectors is converted by Formula 4 into a fixed dimension vector:

$$L = M_{Low} = \frac{f_{Low}}{f_{BW}} \times M_{\max}, \quad \text{Formula 4}$$

$$K = M_{High} = \frac{f_{High}}{f_{BW}} \times M_{fix}.$$

Here, L and $M_{Low}$ are a fixed dimension of a low frequency domain, K and $M_{High}$ are a fixed dimension of a high frequency domain, $f_{BW}$ is a bandwidth of the input signal, $M_{max}$ is a maximum of a variable dimension, and $M_{fix}$ is a specific fixed value.

In addition, preferably, the low frequency domain ranges from 1 Hz to 1000 Hz, and the high frequency domain ranges from 1000 Hz to 8000 Hz.

In addition, preferably, a bandwidth $f_{BW}$ of the input signal is 8000 Hz, a maximum $M_{max}$ of the variable dimension is 128, and a specific fixed value $M_{fix}$ of the fixed dimension is between 80 and 100.

Meanwhile, even though a maximum $M_{max}$ of the variable dimension is fixed at 128 in this exemplary embodiment, the present invention is not limited thereto. When the maximum $M_{max}$ of the variable dimension is smaller than 128, a specific fixed value $M_{fix}$ of the fixed dimension can be fixed at a smaller value than the maximum $M_{max}$ of the variable dimension.

When the vector dimension conversion method according to an exemplary embodiment of the present invention is used, an encoder performs vector quantization after converting a variable dimension vector into fixed dimension vectors. And, in contrast, a decoder decodes received fixed dimension vectors again and then converts the decoded vectors into a vector having an original variable dimension.

Below, the vector dimension conversion method including the process described above according to an exemplary embodiment of the present invention will be compared with conventional vector dimension conversion methods.

For example, a first conventional vector dimension conversion method 1_CB needs one codebook and one specific fixed dimension. Specifically, all harmonic vectors having a variable dimension are converted into a fixed dimension of N. Therefore, a dimension of codewords of the codebook also becomes the dimension of N, the codebook used in the first conventional vector dimension conversion method 1_CB.

A second conventional vector dimension conversion method 2_CB needs two codebooks and two different kinds of fixed dimensions. Specifically, harmonic vectors having a variable dimension that is the same as or smaller than a fixed dimension of N among all harmonic vectors having a variable dimension are converted into the fixed dimension of N, and harmonic vectors having a variable dimension that is larger than a dimension of (N+1) are converted into a fixed dimension of 128. Therefore, the harmonic vectors converted into the fixed dimension of N are quantized using a codebook having the N-th dimension, and the harmonic vectors converted into the fixed dimension of 128 are quantized using a codebook having the dimension of 128.

Lastly, the vector dimension conversion method 1_CB_New according to an exemplary embodiment of the present invention needs one codebook and one fixed dimension varying according to a frequency domain. Specifically, elements included in a subband (Low band) of a low frequency domain below about 1000 Hz among variable dimension vectors are converted into a maximum fixed dimension of 16, and elements included in a subband (High band) of a frequency domain over about 1000 Hz are converted into a fixed dimension of (N−16).

The vector dimensions of the two conventional vector dimension conversion methods and the vector dimension conversion method according to an exemplary embodiment of the present invention as stated above are shown in Table 1:

TABLE 1

| Method | Variable dimension | | Fixed dimension | |
|---|---|---|---|---|
| 1_CB | 20~128 | | N | |
| 2_CB | P ≦ 2N:20~N | | N | |
| | P > 2N:N + 1~128 | | 128 | |
| | Low band | High band | Low band | High band |
| 1_CB_New | 3~16 | 17~112 | 16 | N − 16 |

The vector dimension conversion method 1_CB_New according to an exemplary embodiment of the present invention needs only one codebook but shows a conversion error less than the conventional vector dimension conversion methods 1_CB and 2_CB, and uses less codebook memory.

In other words, in conversion of a variable dimension vector into fixed dimension vectors, the vector dimension conversion method according to the present invention converts elements of a low frequency domain into a maximum fixed dimension such that a conversion error can be reduced, and converts elements of a high frequency domain into a smaller fixed dimension than the maximum fixed dimension to reduce codebook memory.

In general, the SEW spectrum vector is divided into a few subbands for quantization. Elements of a vector included in a subband are quantized according to the subband, and relatively more bits are allocated to a subband of a low frequency domain.

Bits are differently allocated according to subbands as stated above because the human ear shows relatively higher distinguishing ability in a low frequency domain. In an exemplary embodiment of the present invention, the SEW spectrum vector is divided into three subbands having frequency domains between 0 and 1000 Hz, between 1000 and 4000 Hz, and between 4000 and 8000 Hz, respectively.

With respect to each subband, 8 bits are allocated to the frequency domain between 0 and 1000 Hz, 6 bits are allocated to the frequency domain between 1000 and 4000 Hz, and 5 bits are allocated to the frequency domain between 4000 and 8000 Hz. In the dimension conversion process, however, an entire frequency band is divided into two subbands as stated above.

Therefore, in the dimension conversion process, elements included in a subband of the frequency domain between 0 and 1000 Hz are converted into the 16th fixed dimension, and elements included in a subband of a frequency domain between 1000 and 8000 Hz are converted into the (N-16)th fixed dimension.

Figure 4:
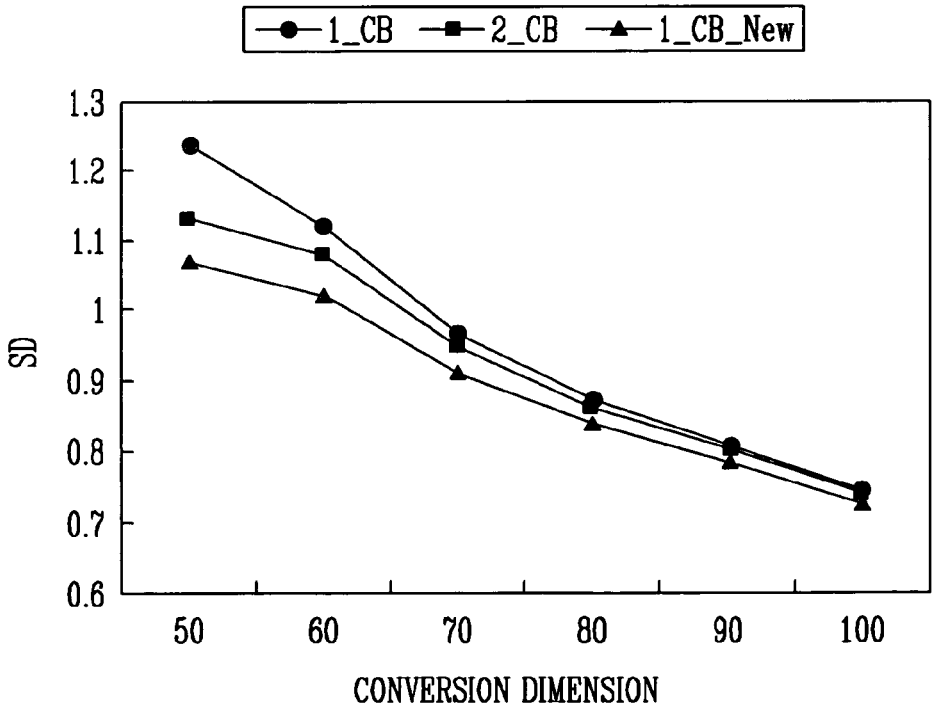
FIG. 4 is a graph for comparing errors in a vector before and after dimension conversion by conventional vector dimension conversion methods and by the vector dimension conversion method according to an exemplary embodiment of the present invention.

FIG. 4 is a graph for comparing errors in a vector before and after dimension conversion by conventional vector dimension conversion methods and by the vector dimension conversion method according to an exemplary embodiment of the present invention.

Referring to FIG. 4, in order to compare the conventional vector dimension conversion methods 1_CB and 2_CB and the vector dimension conversion method 1_CB_New according to an exemplary embodiment of the present invention, the errors between a vector before and after the dimension conversion were measured using a spectral distance (SD) measurement value shown in Formula 5:

$$SD = \sqrt{\frac{1}{L-1}\sum_{k=1}^{L-1}(20\log_{10}S(k) - 20\log_{10}S(k))^2} \quad \text{Formula 5}$$

Here, the SD value is in units of decibels (dB), and (L-1) is the number of samples included for the measurement.

It can be seen that the vector dimension conversion method 1_CB_New according to an exemplary embodiment of the present invention used only one codebook but exhibited a smaller SD value representing conversion error than the second conventional vector dimension conversion method 2_CB using two codebooks.

The second conventional vector dimension conversion method 2_CB showed superior performance to the first conventional vector dimension conversion method 1_CB because results according to the second conventional method 2_CB were relatively close to optimized solutions as stated above.

However, though the second conventional vector dimension conversion method 2_CB showed superior performance, it used almost two times the amount of codebook memory that the first conventional vector dimension conversion method 1_CB used.

Furthermore, when a smaller dimension than the maximum dimension of 128 was allocated to a subband corresponding to a high frequency domain in the vector dimension conversion method 1_CB_New according to an exemplary embodiment of the present invention, a relatively large amount of codebook memory could be saved. This is particularly advantageous for wideband speech coding because the wideband speech coding requires more codebook memory than narrowband speech coding, i.e., about two times compared to narrowband speech coding in SEW quantization.

Meanwhile, Table 2 shows codebook memories required for the three kinds of vector dimension conversion methods 1_CB, 2_CB and 1_CB_New described above:

TABLE 2

| Method | Codebook memory by subband | | | Total codebook memory |
|---|---|---|---|---|
| 1_CB | 16 × 256 | 48 × 64 | 64 × 32 | 9,184 words |
| 2_CB | 10 × 256 | 30 × 64 | 40 × 32 | 14,944 words |
| | 16 × 256 | 48 × 64 | 64 × 32 | |
| 1_CB_New | 16 × 256 | 30 × 64 | 40 × 32 | 7,296 words |

As shown in Table 2, when the vector dimension conversion method 1_CB_New according to an exemplary embodiment of the present invention is configured to use a fixed dimension of 80, the method 1_CB_New shows a memory reduction of about 50% compared to the second conventional vector dimension conversion method 2_CB using two codebooks, and a memory reduction effect of 20% also compared to the first conventional vector dimension conversion method 1_CB using only one codebook.

As stated above, the vector dimension conversion method according to an exemplary embodiment of the present invention can be applied to not only a WI speech coding method but also other speech coding methods such as a harmonic vocoder quantizing a harmonic parameter of a speech signal.

Particularly, for wideband speech signal coding, since about two times more codebook memory is required compared to narrowband speech signal coding, a vector dimension conversion method capable of reducing codebook memory as provided by the present invention is much more advantageous.

According to the vector dimension conversion method of the present invention as described above, for SEW spectrum vector quantization of a WI speech coding process, an entire frequency domain of a variable dimension vector is divided into a plurality of frequency domains, and then a variable dimension vector is converted into vectors of different fixed dimensions according to the divided frequency domains. Therefore, not only an error due to the vector dimension conversion is suppressed but also codebook memory required for the vector quantization is effectively reduced.

In addition, the vector dimension conversion method according to the present invention can be applied to not only a WI speech coding method but also other speech coding methods such as a harmonic vocoder quantizing harmonic parameters of a speech signal, and is much more advantageous particularly for wideband speech signal coding.

While the present invention has been shown and described with reference to certain exemplary embodiments thereof, it will be understood by those skilled in the art that various changes in form and details may be made therein without departing from the spirit and scope of the invention as defined by the appended claims.

What is claimed is:

1. A non-transitory digital multimedia storage device for storing the method of converting a dimension of a vector for vector quantization comprising the steps of:

extracting a specific parameter having the pitch period from the input speech signal and then generating a vector of a dimension that varies according to the pitch period;

dividing an entire frequency domain of the generated vector of the variable dimension into at least two frequency domains; and converting the vector of the variable dimension into vectors of mutually different fixed dimensions according to the divided frequency domains, wherein in the converting the vector of the variable dimension, when the entire frequency domain of the generated vector of the variable dimension is divided into a low frequency domain and a high frequency domain, vectors of a variable dimension corresponding to the low frequency domain are converted into a vector of a maximum fixed dimension, and vectors of a variable dimension corresponding to the high frequency domain are converted into a vector of a lower fixed dimension, wherein in the step of converting the vector of the variable dimension, when the entire frequency domain of the generated vector of the variable dimension is divided into the low frequency domain $f_{Low}$ and the high frequency domain $f_{High}$, vectors of a variable dimension are respectively converted into vectors of fixed dimensions by the following formula:

$$L = M_{Low} = \frac{f_{Low}}{f_{BW}} \times M_{\max},$$

$$K = M_{High} = \frac{f_{High}}{f_{BW}} \times M_{fix}$$

wherein L and $M_{Low}$ are a fixed dimension of the low frequency domain, K and $M_{high}$ are a fixed dimension of the high frequency domain, $f_{BW}$ is a bandwidth of the input signal, M(max) is a maximum of the variable dimension, and $M_{fix}$ is a specific fixed value of a fixed dimension.

2. The method according to claim 1, wherein in the step of extracting the specific parameter and then generating the vector of the variable dimension, the variable dimension is determined by the following formula:

$$M(t) = \left[\frac{P(t)}{2}\right]$$

wherein t is time, M(t) is the variable dimension, and P(t) is a pitch period.

3. The method according to claim 2, wherein the pitch period P(t) ranges from 40 to 256, and the variable dimension M(t) ranges from 20 to 128.

4. The method according to claim 1, wherein in the step of extracting the specific parameter and then generating the vector of the variable dimension, the vector of the variable dimension is either a slowly evolving waveform (SEW) spectrum vector or a harmonic vector.

5. The method according to claim 1, wherein in the step of converting the vector of the variable dimension, the converted vectors of the fixed dimension are stored in one codebook memory.

6. The method according to claim 1, wherein the low frequency domain ranges from 1 Hz to 1000 Hz and the high frequency domain ranges from 1000 Hz to 8000 Hz.

7. The method according to claim 1, wherein the bandwidth f(BW) of the input signal is 8000 Hz, the maximum $M_{max}$ of the variable dimension is 128, and the specific fixed value $M_{fix}$ of the fixed dimension is between 80 and 100.

8. The method according to claim 1, wherein when the maximum $M_{max}$ of the variable dimension is smaller than 128, the specific fixed value $M_{fix}$ of the fixed dimension is fixed at a smaller value than the maximum $M_{max}$ of the variable dimension.

* * * * *